US007298339B1

(12) United States Patent
Ollikainen

(10) Patent No.: US 7,298,339 B1
(45) Date of Patent: Nov. 20, 2007

(54) MULTIBAND MULTIMODE COMPACT ANTENNA SYSTEM

(75) Inventor: Jani Ollikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/476,470

(22) Filed: Jun. 27, 2006

(51) Int. Cl.
*H01Q 1/24* (2006.01)

(52) U.S. Cl. ..... 343/702; 343/700 MS; 343/741

(58) Field of Classification Search ..... 343/700 MS, 343/702, 741, 742, 866, 867
See application file for complete search history.

(56) References Cited

U.S. PATENT DOCUMENTS

| | | | | |
|---|---|---|---|---|
| 6,597,317 | B2 | 7/2003 | Talvitie | 343/700 |
| 2005/0057406 | A1* | 3/2005 | Ohara et al. | 343/702 |
| 2005/0190108 | A1* | 9/2005 | Lin et al. | 343/702 |
| 2005/0270238 | A1* | 12/2005 | Jo et al. | 343/702 |
| 2006/0170600 | A1* | 8/2006 | Korva | 343/702 |
| 2007/0008222 | A1* | 1/2007 | Wang et al. | 343/700 MS |
| 2007/0109201 | A1* | 5/2007 | Licul et al. | 343/702 |

* cited by examiner

*Primary Examiner*—Tho Phan
(74) *Attorney, Agent, or Firm*—Ware, Fressola, Van Der Sluys & Adolphson, LLP

(57) ABSTRACT

An antenna system for use in a communications device, such as a mobile phone. The antenna system has a multiband GSM antenna operating at GSM850, GSM900, GSM 1800 and GSM 1900 that has a short-circuited section located between a separate UMTS antenna and a UMTS receive diversity antenna. As such, large electrical isolation between the two UMTS antennas can be achieved. The UMTS antennas can be short-circuited microstrip loop antennas, IFA, PIFA, ILA or PILA antennas. These antennas are well-isolated antennas instead of coupled antennas. As such, the diversity antenna is well isolated from the main antenna despite its close proximity to the main antenna. Well-isolated antennas have little mutual coupling and, therefore, are easier to design than coupled antennas, because isolated antennas can be tuned independently from each other.

29 Claims, 6 Drawing Sheets

MULTIBAND MULTIMODE COMPACT ANTENNA SYSTEM

FIELD OF THE INVENTION

The present invention relates generally to an RF antenna system and, more specifically, to an internal multiband, multimode antenna system for use in a portable electronic device, such as a mobile terminal.

BACKGROUND OF THE INVENTION

Antenna diversity is a well-known method for improving the performance of RF communications devices in a multipath propagation environment. In antenna diversity, two or more antennas operating at the same frequency band are used to receive the same information over independently fading radio channels. When the signal of one channel fades, the receiver can rely on the one or more other antennas to offer a better signal level. Ideally, the two or more antennas are positioned to provide uncorrelated signals. These signals are then combined according to one of the diversity techniques, such as switched diversity, selection diversity, equal gain and maximal ratio combining. It is also possible to use various interference rejection combining and interference suppression techniques. In general, diversity solutions can reduce the effects of fading and interference at the expense of increased complexity. Nevertheless, diversity can provide, for example, better telephone call quality, improved data rates and increased network capacity without the use of extra frequency spectrum. When implemented in mobile terminals, the benefits of antenna diversity can be achieved without investments in the network infra-structure.

Because of the small volume available for a mobile terminal antenna, it is challenging to design compact antennas that operate efficiently at multiple communication system bands, such as GSM850/(W) CDMA850 (824-894 MHz), GSM900 (880-960 MHz), GSM1800 (1710-1880 MHz), GSM1900/(W) CDMA (1850-1990 MHz) and UMTS (1920-2170 MHz). The designing task becomes even more challenging when additional diversity antennas operating at one or more of those system bands must be included in the same small volume in a mobile phone. In the talk position, one side of a mobile phone is typically covered by the user's head, while the other side is mostly covered by the user's hand. Thus, only a relatively small area and volume is available for the internal antenna system. In order to avoid being covered by the lossy tissues of the user's head and hand, all antennas should be placed within the available small area and volume, typically at the top section of the mobile phone. This leads to small electrical separation between the antennas. Generally, it can be difficult to achieve low correlation between closely spaced antennas. Typically, closely spaced antennas operating at the same frequency bands also couple strongly to each other. The coupling between antennas operating at the same frequency band generally reduces their efficiency. Consequently, the improvement that can be obtained with antenna diversity in noise-limited environment is also adversely affected.

It is thus advantageous and desirable to provide a compact multimode, multiband antenna system wherein a diversity antenna element is used for diversity reception or transmission or both (MIMO—multiple input multiple output).

SUMMARY OF THE INVENTION

The present invention uses a multiband GSM (Global system for mobile communications) antenna operating at GSM850, GSM900, GSM1800 and GSM1900 that has a short-circuited section located between a separate UMTS (Universal mobile telecommunication system) antenna and a UMTS receive diversity antenna. As such, large electrical isolation between the two UMTS antennas can be achieved. In particular, the present invention makes use of well-isolated antennas instead of coupled antennas. As such, the diversity antenna is well isolated from the main antenna despite its close proximity to the main antenna. Well-isolated antennas have little mutual coupling and, therefore, are easier to design than coupled antennas, because isolated antennas can be tuned independently from each other. Furthermore, the present invention is also applicable to CDMA and non-cellular protocols such as WLAN (wireless local area network) and Bluetooth.

Thus, the first aspect of the present invention is an antenna system which comprises:

a first antenna operating at a first frequency range, the first antenna having a substantially planar radiator, and a feed point;

a second antenna operating at a second frequency range, the second antenna having a substantially planar radiator, and a feed point wherein the first and second frequency ranges have at least overlapping frequencies; and a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

In one embodiment of the present invention, the first section of the radiator is connected to the feed point of the third antenna and the second section of the radiator is connected to the ground point of the third antenna.

In another embodiment of the present invention, the first section of the radiator is connected to the ground point of the third antenna and the second section of the radiator is connected to the feed point of the third antenna.

In yet another embodiment of the present invention, the radiator of the third antenna further comprises a third section electrically connected to the second section, wherein the third section is located between the radiator of the second antenna and the second section of the radiator of the third antenna. The radiator of the third antenna my further comprise a third section electrically connected to the second section, wherein the radiator of the second antenna is located between the second and third sections of the radiator of the third antenna. The planar radiator of the first antenna, the planar radiator of the second antenna and the planar radiator of the third antenna my be located substantially on a same plane.

The first and second antennas can be short-circuited microstrip loop antennas, inverted-F antennas, or inverted-L antennas.

The second frequency range can be substantially between 1920 MHz and 2170 MHz and the first frequency range can be substantially between 2110 and 2170 MHz. Alternatively, the second frequency range is substantially between 1920

MHz and 2170 MHz in UMTS mode, and the first frequency range is substantially between 1850 MHz and 1990 MHz.

The third antenna is operable at a frequency range substantially between 824 MHz and 960 MHz, and another frequency range substantially between 1710 MHz and 1990 MHz. Alternatively, third antenna is operable at a frequency range substantially between 824 MHz and 960 MHz, and another frequency range substantially between 1710 MHz and 1990 MHz.

Preferably, one or more of the first, second and third antennas are electronically frequency tunable.

The second aspect of the present invention is a communications device which includes:

an antenna system disposed on a least a part of a circuit board, the antenna system comprising:

a first antenna operating at a first frequency range, the first antenna having a substantially planar radiator, and a feed point;

a second antenna operating at a second frequency range, the second antenna having a substantially planar radiator, and a feed point wherein the first and second frequency ranges have at least overlapping frequencies; and a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

The communications device can be a mobile terminal, a communicator device and the like.

The third aspect of the present invention provides a method for use in communications. The method comprises:

disposing a first antenna adjacent to a second antenna, wherein the first antenna is configured to operate at a first frequency range, the first antenna having a substantially planar radiator, and a feed point, and wherein the second antenna is configured to operate a second frequency range at least partially overlapping with the first frequency range; and disposing a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna. The method may further comprise electrically connecting a third radiator section to the second section of the radiator of the third antenna, wherein the third radiator section is located further away from the first section and adjacent to the second antenna, and co-locating the planar radiator of the first antenna, the planar radiator of the second antenna and the planar radiator of the third antenna substantially on a same plane.

The present invention will become apparent upon reading the description of exemplary examples as depicted in FIGS. 1 to 6.

DETAILED DESCRIPTION OF THE INVENTION

Figure 1:
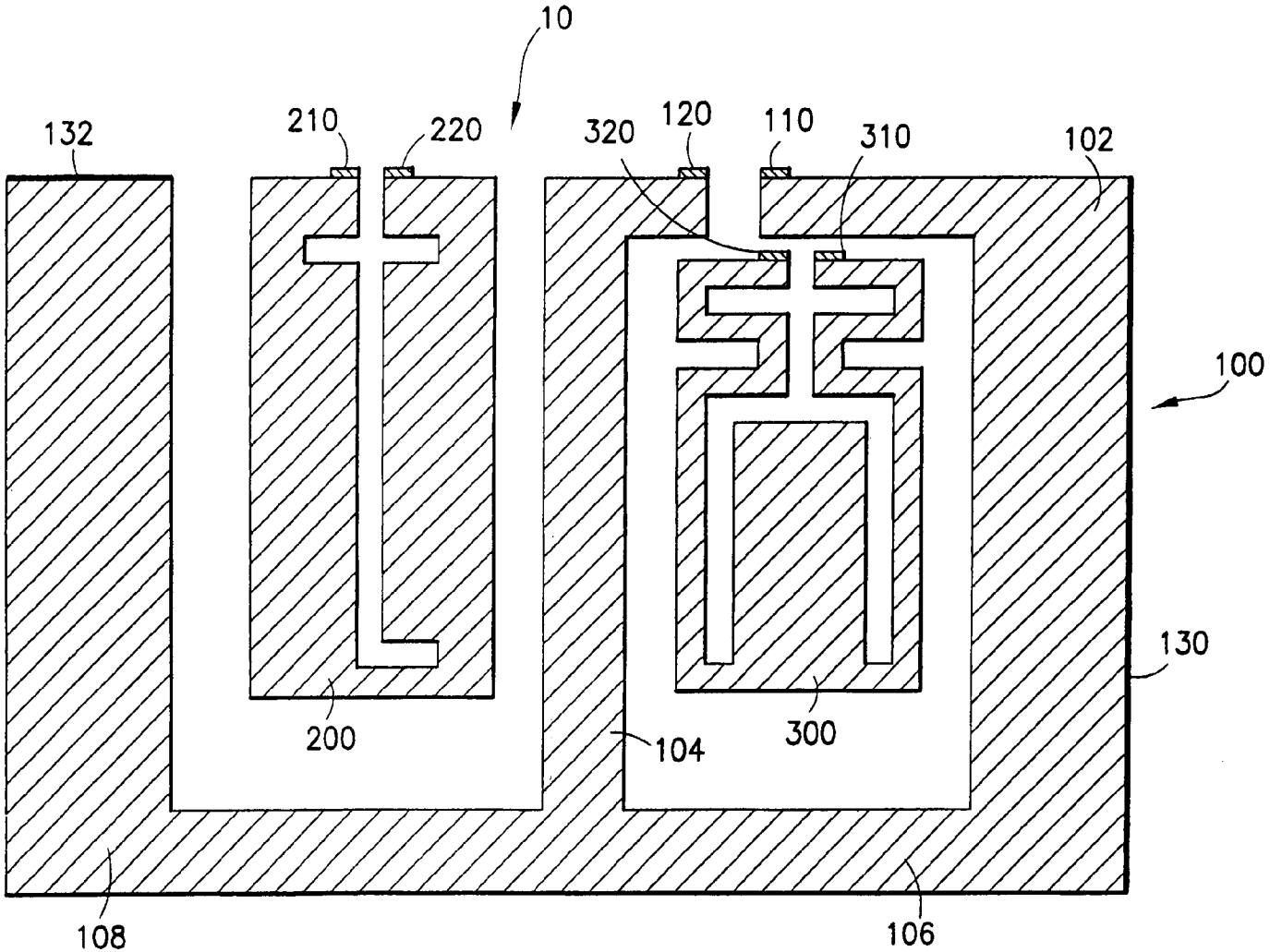
FIG. 1 is a top view showing an embodiment of a compact multiband antenna system, according to the present invention.
Figure 5:
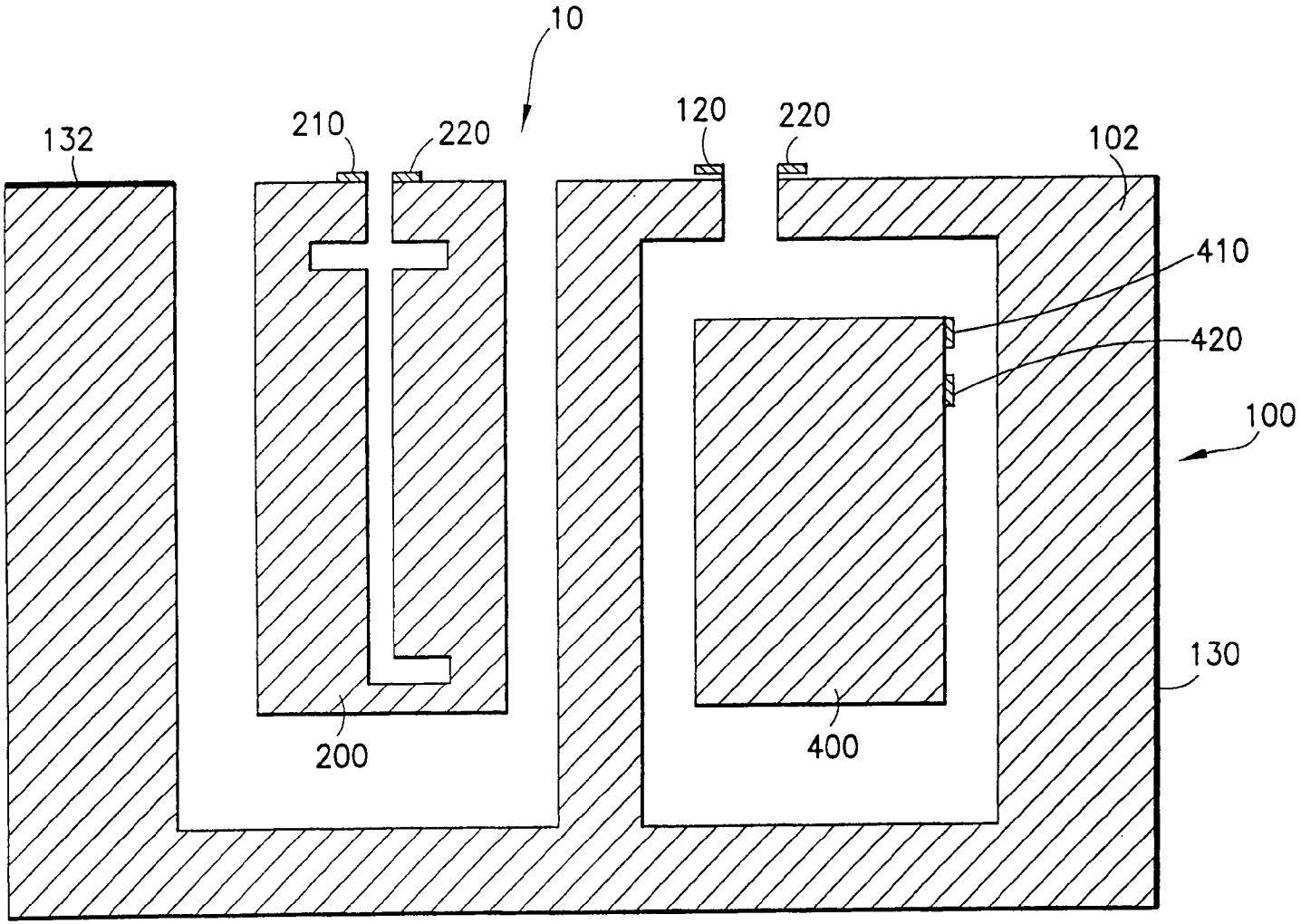
FIG. 5 is a top view showing yet another embodiment of the compact multiband antenna system, according to the present invention.

An embodiment of the multiband antenna system, according to the present invention, is shown in FIG. 1. As shown, the antenna system 10 comprises three separate antennas: a GSM antenna 100, a separate UMTS antenna 200 and a UMTS receive diversity antenna 300. All three antennas have planar radiators located substantially on the same plane. The UMTS antenna 200 operates in a frequency range of 1920-2170 MHz, and has a feed point 210 and a grounding point 220. The UMTS receive diversity antenna 300 operates in a frequency of 2110-2170 MHz, and has a feed point 310 and a grounding point 320. As shown, each of the UMTS antennas 200 and 300 is a short-circuited microstrip loop antenna element. Typically a short-circuited microstrip loop antenna comprises a short circuit connected to a feed by an approximately half-wave section of the microstrip line. It should be noted that one or both UMTS antennas 200, 300 can be replaced by an inverted-F antenna (IFA), a planar inverted-F antenna (PIFA), an inverted-L antenna (ILA), or an planar inverted-L antenna (PILA). The IFA and PIFA are typically self-resonant. The ILA and PILA can be self-resonant or resonated by an additional matching circuit. Additional matching resonators can be added to all antennas to increase their operation bandwidth. The PIFA 400 is shown in FIG. 5.

As shown in FIG. 1, the GSM antenna 100 comprises at least a first planar radiator section 102 connected to a feed point 110, a second planar radiator section 104 connected to a grounding point 120, and a planar radiator section 106 for connecting the first 102 and the second 104 planar radiator sections. As such, these three planar sections substantially form a loop surrounding the UMTS receive diversity antenna 300. According to the present invention, the short-circuited section 104 is located between the separate UMTS antenna 200 and the UMTS receive diversity antenna 300. With such an arrangement, the short-circuited section 104 provides electronic isolation between the two UMTS antennas 200, 300, thereby achieving a sufficiently low envelope correlation (pe), for example <0.7; for good diversity performance and an improvement in isolation over 10 dB. Measurement results indicate that the electrical isolation between the two UMTS antennas of 20 dB, for example, can be achieved.

The GSM antenna 100, as shown in FIG. 1, further comprises another radiator section 108, so that three sides of the UMTS antenna 200 are substantially surrounded by part of the GSM antenna 100. With the radiator section 108, the GSM antenna 100 can operate, for example, as a multiband GSM antenna, operable in GSM850, GSM900, GSM1800 and GSM1900 frequency bands.

Figure 2:
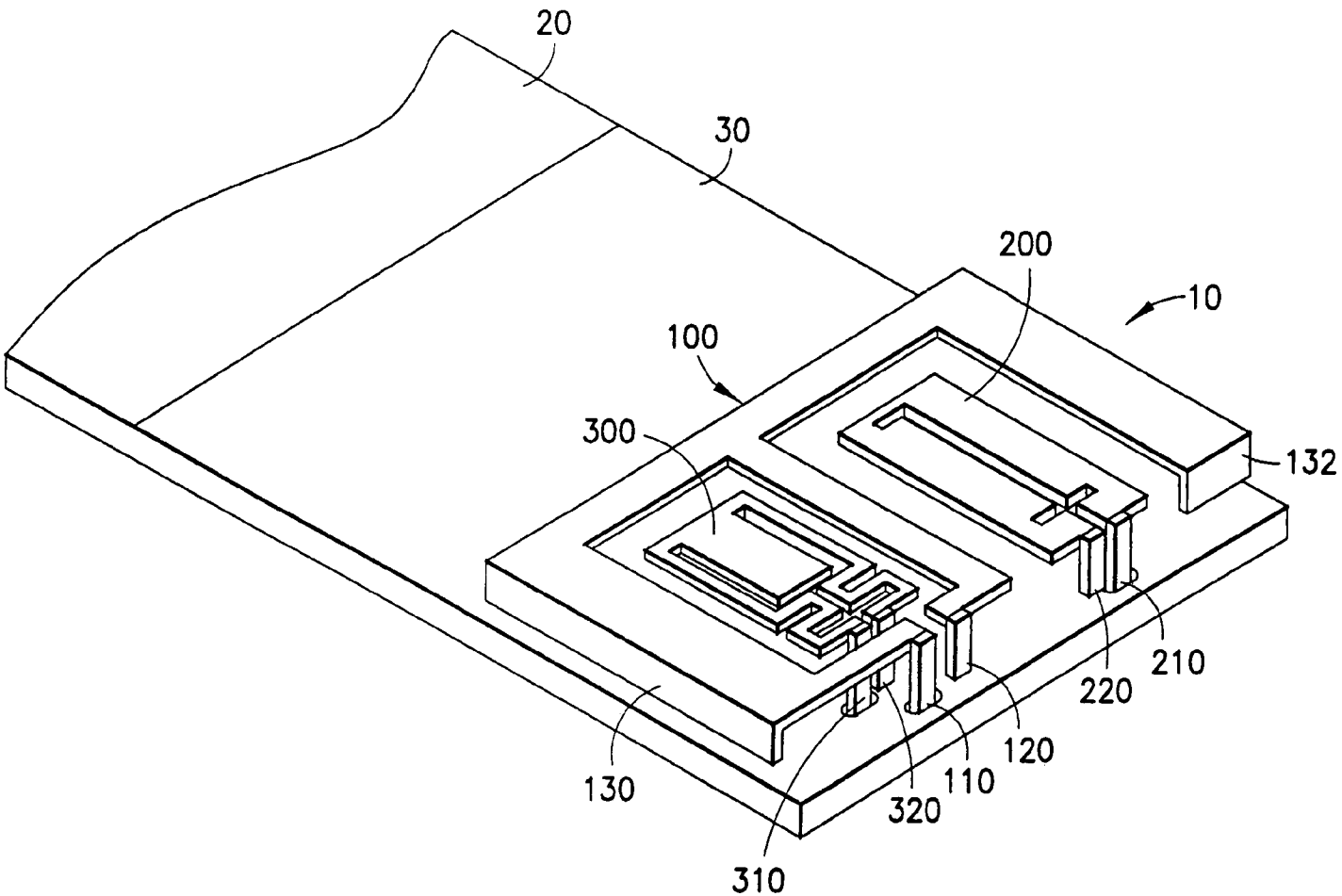
FIG. 2 is an isometric view showing the compact multiband antenna system of FIG. 1 disposed on a substrate or a printed wired board.

The integrated antenna system 10 can be implemented on a substrate, a printed circuit board (PCB) or a printed wire board (PWB) 20, for example. The PWB 20 has a ground plane 30 connected to the grounding points 120, 220 and 320, as shown in FIG. 2. It is possible to provide capacitive loads 130, 132 operatively connected to the radiator sections or to bend parts of the antennas toward the ground plane in order to decrease the resonant frequencies of the antenna elements without increasing the overall size of the integrated antenna system 10, as shown in FIGS. 1 and 2. Similar effect can also be achieved by using dielectrics (low-loss plastics or ceramics, for example). In an alternative arrangement (not shown) the integrated antenna system 10 may partially overlap the ground plane 30 in order to improve the bandwidth performance.

Figure 3:
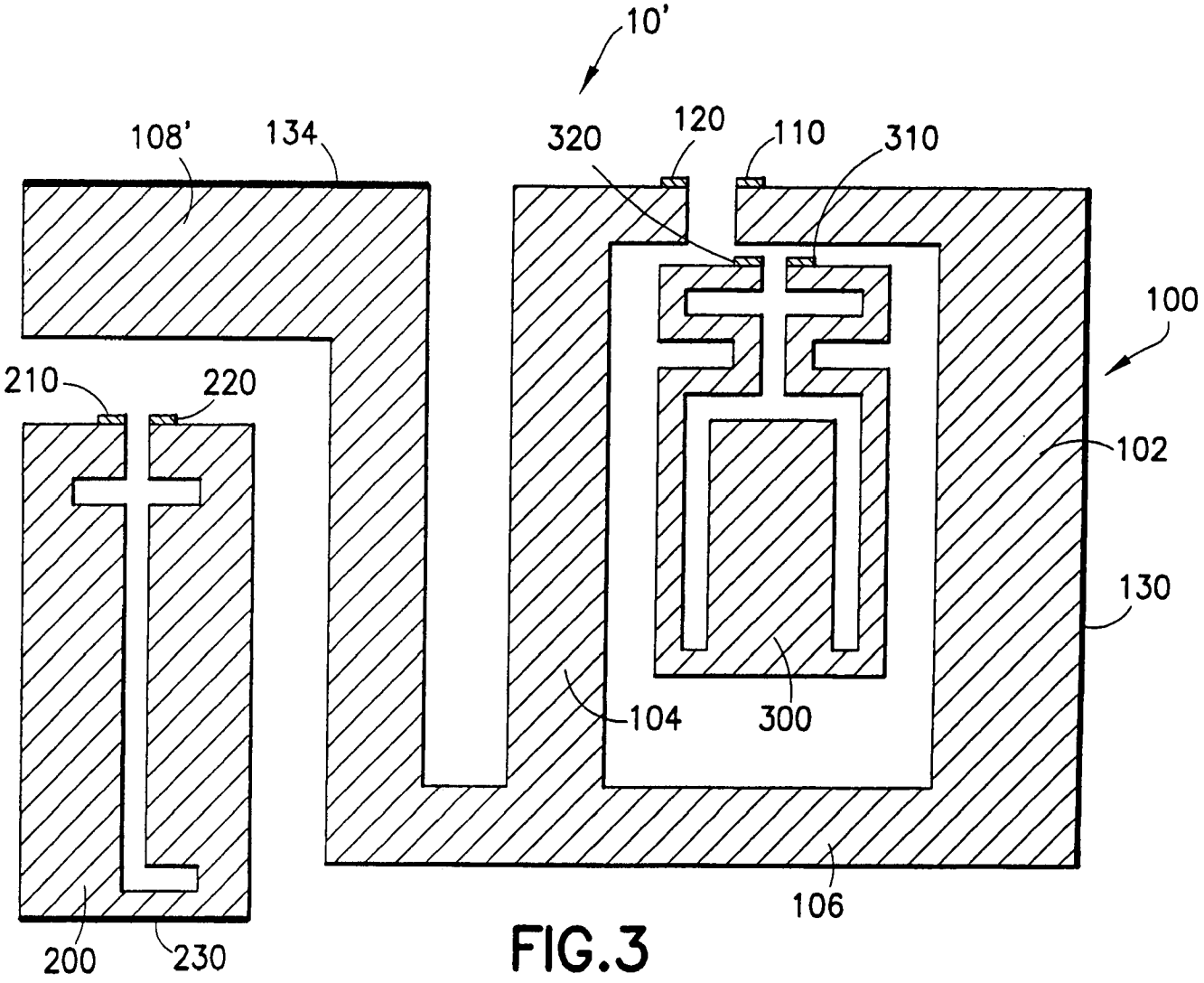
FIG. 3 is a top view showing another embodiment of the compact multiband antenna system, according to the present invention.
Figure 4:
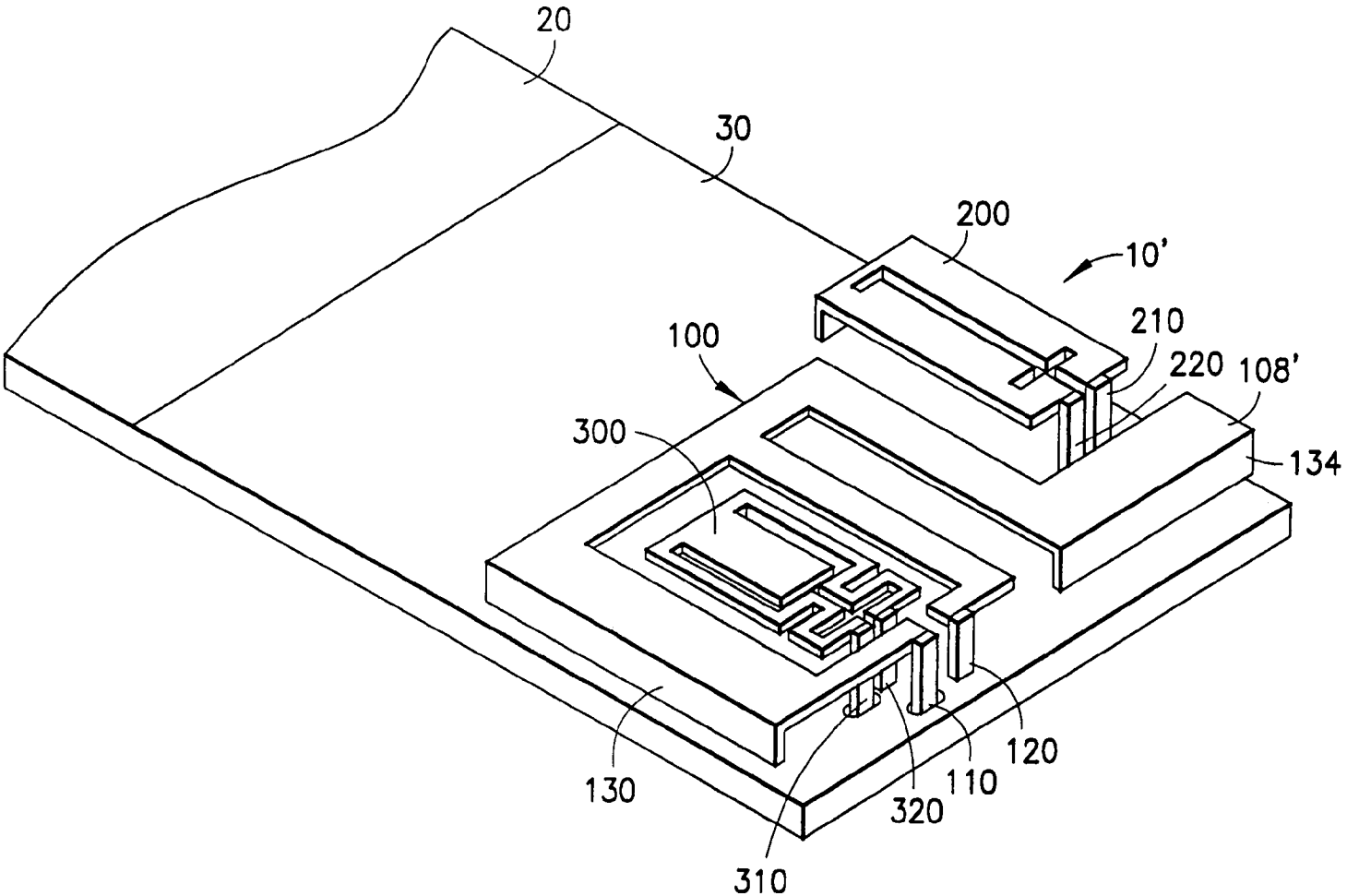
FIG. 4 is an isometric view showing the compact multiband antenna system of FIG. 3 disposed on a substrate or a printed wire board.

Another embodiment of the present invention is shown in FIGS. 3 and 4. As shown, the radiator section 108' is now shaped differently. Only two sides of the UMTS antenna 200 are substantially surrounded by part of the GSM antenna 100. With this embodiment, the main UMTS antenna 200 is moved further away from the UMTS receive diversity antenna 300, without significantly increasing the antenna volume. Such an arrangement can result in a further bandwidth and total efficiency improvement. As shown in FIGS. 3 and 4, an additional capacitive load 230 is used to decrease the resonant frequency of the main UMTS antenna 200.

It should be noted that, one or both of the short-circuited microstrip loop UMTS antennas 200, 300 can be replaced by an IFA, PIFA, ILA, or PILA, for example. As shown in FIG. 5, a PIFA 400 having a feed point 410 and a grounding point 420 is used to replace the UMTS receive diversity antenna 300.

In sum, the integrated multiband antenna system of the present invention comprises two UMTS antennas and one GSM antenna. The GSM antenna is a microstrip antenna having a short-circuited radiator section located between the two UMTS antennas in order to achieve efficient isolation between the two UMTS antennas. The advantages of the present invention include:

- A compact antenna system having a multiband GSM antenna, a UMTS antenna and a UMTS receive diversity antenna becomes feasible.
- All antennas (GSM850/900/1800/1900, UMTS and UMTS diversity) can be combined into one antenna module and manufactured simultaneously in order to reduce manufacturing cost.
- Diversity antennas can be implemented without significantly increasing the total antenna volume.
- All of the GSM receiver, the main UMTS receiver and the UMTS diversity receiver can be located close to each other, rendering it unnecessary to have long RF lines.
- Sufficiently large isolation between the main UMTS antenna and the UMTS receive diversity antenna is achievable, ensuring that efficiency at the UMTS receive (Rx) band is not reduced by mutual coupling.
- Sufficiently low correlation between the signals of the two UMTS antennas is achieved for good diversity performance although the physical separation between the two UMTS antenna elements is small.
- All antennas can be located in an area where they are least likely to be covered by the user's hand. Avoiding the absorption loss by the lossy tissues in the user's hand effectively maximizes the efficiency of the antennas and, at the same time, minimizes the difference in average signal power levels.
- It is possible to achieve a large bandwidth at lower GSM bands.

Figure 6:
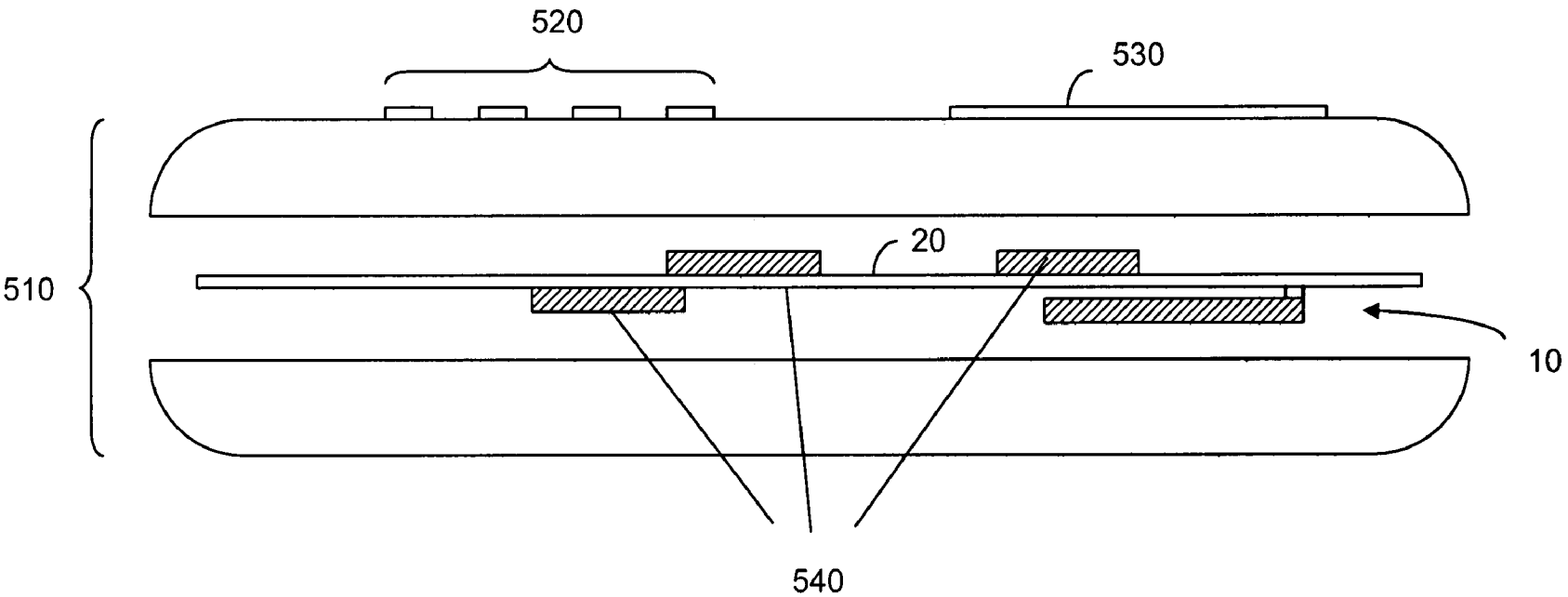
FIG. 6 is a schematic representation showing a mobile terminal that uses the compact multiband antenna system, according to various embodiments of the present invention.

The integrated multiband antenna system 10, according to the present invention, can be used in a mobile terminal, for example. As shown in FIG. 6, the mobile terminal 500 comprises a housing 510 for housing the PWB 20 having at one end thereof the integrated antenna system 10. One or more electronic components 540, including the transceiver front-end connected to the three antennas, can be disposed on the PWB 20. The housing 510 typically comprises a plurality of keys 520 and a display 530.

It should be noted that, if diversity is not needed, the UMTS receive diversity antenna 300 can be replaced by a camera or a speaker, for example. As such, the same antenna arrangement (without the diversity antenna) can still be used as a multiband GSM850/900/1800/1900 and UMTS antenna system.

The present invention uses a multiband GSM having a short-circuited section located between a separate UMTS antenna and a UMTS receive diversity antenna. The antenna system can be made to cover GSM850/(W) CDMA850 (824-894 MHz), E-GSM900 (880-960 MHz), GSM1800 (1710-1880 MHz), GSM1900/(W) CDMA (1850-1990 MHz) and UMTS (1920-2170 MHz). The GSM can be a quad-band (GM850/900/1800/1900) or a triple-band antenna, for example and the antenna system can cover any combination of the above-mentioned bands. Typically, the GSM antenna has a substantially planar radiator, a feed point and a ground point, wherein the radiator has a first section connected to the feed point, a second section connected to the ground point, and a connecting section connecting the first section to the second section. The second section is located between the radiator of the UMTS antenna and the radiator of the UMTS receive diversity antenna. Alternatively, the locations of the feed and the short are exchanged such that the second section is electrically connected to the feed point and the first section is electrically connected to the ground point. Furthermore, any of the above-mentioned antennas can be electrically frequency tunable. As such, it is possible to increase the operation bandwidths and the total efficiencies of the antennas by electrically tuning their resonance frequencies. The UMTS antennas can be short-circuited microstrip loop antennas, inverted-F antennas, planar inverted-F antennas, inverted-L antennas or planar inverted-L antennas.

It should be noted that although the main use of the present invention is for diversity antennas, the present invention is also used for frequency bands that are very close to one another and therefore the operation of one antenna (first antenna) could be affected by the locality of the other (second antenna). Furthermore, the present invention is applicable to CDMA and non-cellular protocols such as WLAN, Bluetooth and the like. The present invention has been disclosed using GSM and UMTS only as a specific example.

In sum, the present invention provides an antenna system which comprises:

a first antenna operating at a first frequency range, the first antenna having a substantially planar radiator, and a feed point;

a second antenna operating at a second frequency range, the second antenna having a substantially planar radiator, and a feed point wherein the first and second frequency ranges have at least overlapping frequencies; and a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

The present invention also provides a method for use in communications, which comprises:

disposing a first antenna adjacent to a second antenna, wherein the first antenna is configured to operate at a first frequency range, the first antenna having a substantially planar radiator, and a feed point, and wherein the second antenna is configured to operate a second frequency range at least partially overlapping with the first frequency range; and disposing a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

The method of claim may further comprises:

electrically connecting a third radiator section to the second section of the radiator of the third antenna, wherein the third radiator section is located further away from the first section and adjacent to the second antenna, and co-locating the planar radiator of the first antenna, the planar radiator of the second antenna and the planar radiator of the third antenna substantially on a same plane.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. An antenna system comprising:

a first antenna operating at a first frequency range, the first antenna having a substantially planar radiator, and a feed point;

a second antenna operating at a second frequency range, the second antenna having a substantially planar radiator, and a feed point wherein the first and second frequency ranges have at least overlapping frequencies; and a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

2. The antenna system of claim 1, wherein the first section of the radiator is connected to the feed point of the third antenna and the second section of the radiator is connected to the ground point of the third antenna.

3. The antenna system of claim 1, wherein the first section of the radiator is connected to the ground point of the third antenna and the second section of the radiator is connected to the feed point of the third antenna.

4. The antenna system of claim 1, wherein the radiator of the third antenna further comprises a third section electrically connected to the second section, and wherein the third section is located between the radiator of the second antenna and the second section of the radiator of the third antenna.

5. The antenna system of claim 4, wherein third antenna is operable at a frequency range substantially between 824 MHz and 960 MHz, and another frequency range substantially between 1710 MHz and 1990 MHz.

6. The antenna system of claim 1, wherein the radiator of the third antenna further comprises a third section electrically connected to the second section, and wherein the radiator of the second antenna is located between the second and third sections of the radiator of the third antenna.

7. The antenna system of claim 6, wherein third antenna is operable at a frequency range substantially between 824 MHz and 960 MHz, and another frequency range substantially between 1710 MHz and 1990 MHz.

8. The antenna system of claim 6, wherein the second section and the third section of the radiator of the third antenna form at least a partial loop surrounding part of the second antenna.

9. The antenna system of claim 1, wherein the planar radiator of the first antenna, the planar radiator of the second antenna and the planar radiator of the third antenna are located substantially on a same plane.

10. The antenna system of claim 9, wherein the first section, the connecting section and the second section of the radiator of the third antenna form an open loop surrounding the first antenna.

11. The antenna system of claim 9, wherein the third antenna further comprises an extended section from the second section, and the extended section is located on a plane different from the planar radiator.

12. The antenna system of claim 1, wherein the first antenna comprises a short-circuited microstrip loop antenna.

13. The antenna system of claim 1, wherein the first antenna comprises an inverted-F antenna.

14. The antenna system of claim 1, wherein the first antenna comprises an inverted-L antenna.

15. The antenna system of claim 1, wherein the second antenna comprises a short-circuited microstrip loop antenna.

16. The antenna system of claim 1, wherein the second antenna comprises an inverted-F antenna.

17. The antenna system of claim 1, wherein the second antenna comprises an inverted-L antenna.

18. The antenna system of claim 1, wherein the second frequency range is substantially between 1920 MHz and 2170 MHz and the first frequency range is substantially between 2110 and 2170 MHz.

19. The antenna system of claim 1, wherein the second frequency range is substantially between 1920 MHz and 2170 MHz in UMTS mode, and the first frequency range is substantially between 1850 MHz and 1990 MHz.

20. The antenna system of claim 1, wherein one or more of the first, second and third antennas are electronically frequency tunable.

21. A communications device comprising:

an antenna system disposed on a least a part of a circuit board, the antenna system comprising:

a first antenna operating at a first frequency range, the first antenna having a substantially planar radiator, and a feed point;

a second antenna operating at a second frequency range, the second antenna having a substantially planar radiator, and a feed point wherein the first and second frequency ranges have at least overlapping frequencies; and a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna.

22. The communications device of claim 21, wherein the radiator of the third antenna further comprises a third section electrically connected to the second section, located further away from the first section.

23. The communications device of claim 22, wherein the second frequency range is substantially between 1920 MHz and 2170 MHz and the first frequency range is substantially between 2110 and 2170 MHz, and wherein third antenna is operable at a frequency range substantially between 824 MHz and 960 MHz, and another frequency range substantially between 1710 MHz and 1990 MHz.

24. The communications device of claim 22, wherein the second frequency range is substantially between 1920 MHz and 2170 MHz in UMTS mode, and the first frequency range is substantially between 1850 MHz and 1990 MHz, and wherein third antenna is operable at a frequency range substantially between 824 MHz and 960 MHz, and another frequency range substantially between 1710 MHz and 1990 MHz.

25. The communications device of claim 21, wherein the planar radiator of the first antenna, the planar radiator of the second antenna and the planar radiator of the third antenna are located substantially on a same plane.

26. The communications device of claim 21, comprising a mobile terminal.

27. A method for use in communications, comprising:

disposing a first antenna adjacent to a second antenna, wherein the first antenna is configured to operate at a first frequency range, the first antenna having a substantially planar radiator, and a feed point, and wherein the second antenna is configured to operate a second frequency range at least partially overlapping with the first frequency range;

disposing a third antenna operating at a third frequency range having frequencies lower than the second frequency range and the first frequency range, the third antenna having a substantially planar radiator, a feed point and a ground point, wherein the radiator of the third antenna has a first section, a second section, and a connecting section connecting the first section to the second section, and wherein the radiator of the first antenna is located between the first section and the second section of the radiator of the third antenna and the second section of the radiator of the third antenna is located between the first antenna and the second antenna; and electrically connecting a third radiator section to the second section of the radiator of the third antenna, wherein the third radiator section is located further away from the first section and adjacent to the second antenna.

28. The method of claim 27, wherein the second frequency range is substantially between 1920 MHz and 2170 MHz and the first frequency range is substantially between 2110 and 2170 MHz, and wherein third antenna is operable at a frequency range substantially between 824 MHz and 960 MHz, and another frequency range substantially between 1710 MHz and 1990 MHz.

29. The method of claim 27, wherein the second frequency range is substantially between 1920 MHz and 2170 MHz in UMTS mode, and the first frequency range is substantially between 1850 MHz and 1990 MHz, and wherein third antenna is operable at a frequency range substantially between 824 MHz and 960 MHz, and another frequency range substantially between 1710 MHz and 1990 MHz.

* * * * *